US006401423B1

(12) United States Patent
Bergeron et al.

(10) Patent No.: US 6,401,423 B1
(45) Date of Patent: Jun. 11, 2002

(54) DEFLECTOR TRACK TABS FOR POSITIONING STUDS ALONG THE TRACK

(75) Inventors: Mark P. Bergeron, Clifton Park; Lawrence C. Dippold, Rexford, both of NY (US)

(73) Assignee: B & D Industries, Albany, NY (US)

( * ) Notice: Subject to any disclaimer, the term of this patent is extended or adjusted under 35 U.S.C. 154(b) by 0 days.

(21) Appl. No.: 09/501,727

(22) Filed: Feb. 10, 2000

(51) Int. Cl.[7] ..... E04C 3/30

(52) U.S. Cl. ..... 52/733.3; 52/241; 52/481.1; 52/712; 52/730.1; 52/731.1; 52/731.9; 52/745.19; 52/696

(58) Field of Search ..... 52/238.1, 243, 52/242, 290, 481.1, 481.2, 696, 781, 781.3, 732.3, 733.2, 733.3, 731.5, 731.9, 653.1, 317, 745.17, 745.18, 745.19, 741.1, 730.1

(56) References Cited

U.S. PATENT DOCUMENTS

| | | | | | |
|---|---|---|---|---|---|
| 2,387,389 | A | * | 10/1945 | Goldsmith | |
| 2,966,708 | A | * | 1/1961 | Freeman, Jr. | |
| 4,080,771 | A | * | 3/1978 | Weller | 52/735 |
| 4,459,790 | A | | 7/1984 | Vermillion | |
| 4,555,889 | A | * | 12/1985 | Mankowski | 52/726 |
| 4,638,615 | A | * | 1/1987 | Taylor | 52/364 |
| 4,805,364 | A | | 2/1989 | Smolik | |
| 4,854,096 | A | | 8/1989 | Smolik | |
| 4,965,980 | A | * | 10/1990 | Leavens | 52/712 |
| 4,986,052 | A | * | 1/1991 | Nelson | 52/745 |
| 5,222,335 | A | | 6/1993 | Petrecca | |
| 5,353,560 | A | | 10/1994 | Heydon | |
| 5,394,665 | A | | 3/1995 | Johnson | |
| 5,655,344 | A | | 8/1997 | Moen et al. | |
| 5,660,012 | A | | 8/1997 | Knudson | |
| 5,797,233 | A | | 8/1998 | Hascall | |
| 5,870,874 | A | * | 2/1999 | Brothers | 52/696 |
| 5,930,968 | A | | 8/1999 | Pullam | |

* cited by examiner

*Primary Examiner*—Carl D. Friedman
*Assistant Examiner*—Yvonne M. Horton
(74) *Attorney, Agent, or Firm*—Schmeiser, Olsen & Watts

(57) ABSTRACT

A deflector track tab structure, and method of formation, for positioning studs along a deflector track. Starting with a sheet of metal such as steel, tongues are formed within the sheet such that the tongues are oriented along the length of the sheet. Slats are formed in each tongue, wherein the slats are oriented along the length of the tongue. The tongues are bent away from the sheet resulting in tabs integral with the sheet and normal to the sheet. A flange is formed from the sheet on each side of the sheet such that a track web between the flanges remains. The flanges are normal to the web and oriented parallel to the tabs. A marker pattern may be formed on each tab to denote a position on each slat for subsequent coupling of metal studs to the tabs. After the track is coupled to a ceiling structure with the flanges and tabs pointing vertically downward, studs are fastened to the tabs at the denoted positions on the slats, such that the stud is separated from the track web by at least δ, where δ is a maximum allowed track deflection under gravitational live load normal to the web of the deflector track.

26 Claims, 7 Drawing Sheets

DEFLECTOR TRACK TABS FOR POSITIONING STUDS ALONG THE TRACK

BACKGROUND OF THE INVENTION

1. Technical Field

The present invention relates to a deflector track tab structure, and method of formation, for positioning studs along a deflector track.

2. Related Art

A building may be framed with vertically-oriented, C-shaped steel studs distributed along the outer perimeter of the building with a spacing between studs typically between 16 inches and 24 inches. Each stud has a web and two flanges, such the flanges laterally bound the web along the length of the web and are normal to the web. The stud may be an exterior stud such that a stud flange is parallel and adjacent to an exterior wall of the building and faces toward the outside of the building. The exterior-facing flange is subject to horizontal wind stress and the stud is designed to withstand a maximum of such horizontal wind stress in accordance with engineering standards or as specified by a building code. Alternatively, the stud may be an interior stud such that a stud flange is parallel and adjacent to an interior wall of the building and, accordingly, the stud is not required to withstand any wind stress.

Regardless whether the stud is an exterior stud or an interior stud, however, the stud is not designed to withstand gravitational live loads originating on a floor directly above the stud, wherein gravitational live loads are directed vertically downward on the floor above the stud. Such gravitational live loads may include any weight on the floor above the stud, such as furniture and people. A method of preventing gravitational live loads from being transmitted to the studs includes use of deflector tracks. A deflector track is a C-shaped track having a web and two flanges. The deflector track is mechanically coupled to the floor directly above the studs, with the deflector track web horizontally oriented (e.g., parallel to a ceiling above), and with the track flanges normal to the track web and pointing gravitationally downward (i.e., vertically downward) away from the floor above. The deflector track is typically fastened to the bottom of an I-beam above the track, such as by a powder actuator nail attachment followed by welding and screw fastening. The deflector track is typically 25 to 30 feet in length and is located directly above a group of studs. Gravitational live load on the floor above will cause the floor above to move vertically downward, which will cause the deflector track to likewise move vertically downward. In the absence of gravitational live load, the deflector track web must be vertically separated from the studs by more than a predetermined maximum allowed track deflection that could result from gravitational live load. The maximum allowed track deflection is typically about one inch. With the aforementioned vertical separation greater than the maximum allowed track deflection, the deflector track will not contact the studs below the deflector track under gravitational live-load conditions, and the gravitational live loads will therefore not be transmitted to the studs below. Instead, the gravitational live loads will be transmitted to other mechanical structures of the building, such as vertical posts which are distributed along the outer perimeter of the building and mechanically coupled to the floors of the building by such coupling mechanisms as bar joists and I-beams.

The studs are typically fastened mechanically to flanges of a horizontally-oriented second track, and the second track is located within and below the deflector track. The second track is not coupled to the deflector track and is vertically separated from the deflector track by about an inch typically. The mechanical fastening of the studs to the second track is typically accomplished by using flathead screws and serves to effectuate a desired horizontal spacing between successive studs. A determination of the positions along the second track at which the studs will be fastened requires measurement and is thus labor intensive. Additionally, such measurement is subject to human error. Thus, it would be desirable to accomplish the fastening of the studs to a track (located above the studs) without requiring the aforementioned measurement, which would save labor costs and eliminate the possibility of human error in performing the measurement. It would also be desirable to eliminate the need for the second track, which would further reduce costs as well as simplify the design.

SUMMARY OF THE INVENTION

The present invention provides a method for forming a deflector track structure that includes a deflector track, comprising the steps of:

predetermining a maximum allowed track deflection $\delta$ under gravitational live load normal to a web of the deflector track;

predetermining a length K, wherein K exceeds $\delta$, wherein K is a no-load distance that will separate the web and a stud after the stud is subsequently coupled to the track, and wherein the stud is adapted to be coupled to the track;

providing a sheet of metal having a length along an x-direction, a width along a y-direction, and a thickness along a z-direction, wherein the x-direction, the y-direction, and the z-directions define an orthogonal coordinate system;

forming at least one tongue within the sheet of metal, wherein an end of the tongue is integral with the sheet, and wherein the end of the tongue is oriented in the y-direction;

forming at least one slat within the tongue, wherein the slat is oriented in the x-direction, and wherein a length of the slat in the z-direction exceeds $2\delta$;

bending the tongue rotationally about the end of the tongue, resulting in the tongue becoming a tab oriented in the z-direction such that the end of the tongue remains as an end of the tab;

bending a first side of the sheet of metal rotationally about a first line in the sheet of metal to form a first flange of the deflector track, wherein the first line is oriented in the x-direction, wherein the first flange is oriented in the z-direction, wherein the web of the deflector track remains, wherein a length of the web is oriented in the x-direction, and wherein a height of the first flange in the z-direction exceeds $K+\delta$; and bending a second side of the sheet of metal rotationally about a second line in the sheet of metal to form a second flange of the deflector track, wherein the second line is oriented in the x-direction, wherein the second flange is oriented in the z-direction, and wherein a height of the second flange in the z-direction exceeds $K+\delta$.

The present invention provides a deflector track, comprising:

a web made of a metal and having a length, a width, and a thickness;

a first flange on a first side of the web, wherein the first flange is integral with the web, wherein the first flange is oriented in a direction normal to the web, wherein a height of the first flange exceeds K+δ, wherein δ is a predetermined maximum allowed track deflection under gravitational live load normal to the web of the deflector track, wherein K is a length that exceeds δ, wherein K is a no-load distance that will separate the web and a stud after the stud is subsequently coupled to the track, and wherein the stud is adapted to be coupled to the track;

a second flange on a second side of the web, wherein the second flange is integral with the web, wherein the second flange is oriented in the direction normal to the web, and wherein a height of the second flange exceeds K+δ; and at least one tab, wherein the tab is integral with the web, wherein a width of the tab is oriented along a width of the web, wherein a height of the tab is oriented in the direction normal to the web, wherein the tab includes at least one slat, wherein the slat has a length that exceeds 2δ; and wherein the slat is oriented in the direction of the height of the tab.

The present invention has the advantage of positioning studs along a deflector track without measuring positions along the deflector track at which the studs will be fastened, which saves labor costs and eliminates human error that might otherwise occur if such measuring were required.

The present invention has the advantage of eliminating the need for a second track to which the studs would otherwise be fastened.

The present invention has the advantage of having a deflector track with a tab integral to the track, which constitutes a one-piece design that can be inexpensively and reliably fabricated.

The present invention has the advantage of being applicable to studs used for either exterior framing or interior framing of a building.

DETAILED DESCRIPTION OF THE INVENTION

Figure 1:
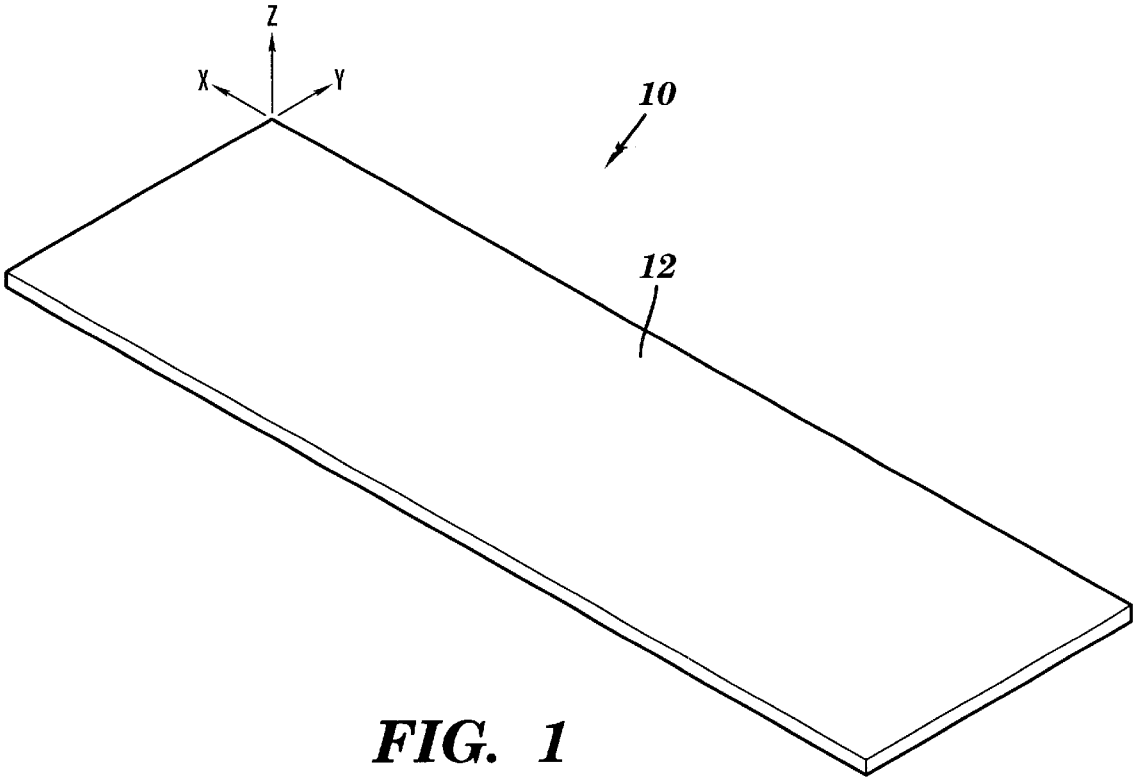
FIG. 1 depicts a top perspective view of a metal sheet and a surface thereof, in accordance with a preferred embodiment of the present invention.

FIG. 1 illustrates a top perspective view of a metal sheet 10, having a surface 12 in accordance with a preferred embodiment of the present invention. The metal sheet has a length oriented in an x-direction, a width oriented in a y-direction, an a thickness oriented in a z-direction. The x-direction, y-direction, and z-direction collectively constitute an orthogonal coordinate system. The metal sheet should have an yield strength that is compatible with design objectives for the intended application. For example, if the metal sheet is used to form a deflector track that is to be positioned where it will be subjected to horizontal wind stresses, then the metal sheet should have a yield strength that would enable the deflector track to withstand such horizontal wind stresses. The metal sheet preferably includes steel, which has a yield strength of about 33 kpsi, but may alternatively include non-metallic substances such as polymer composites.

Figure 2:
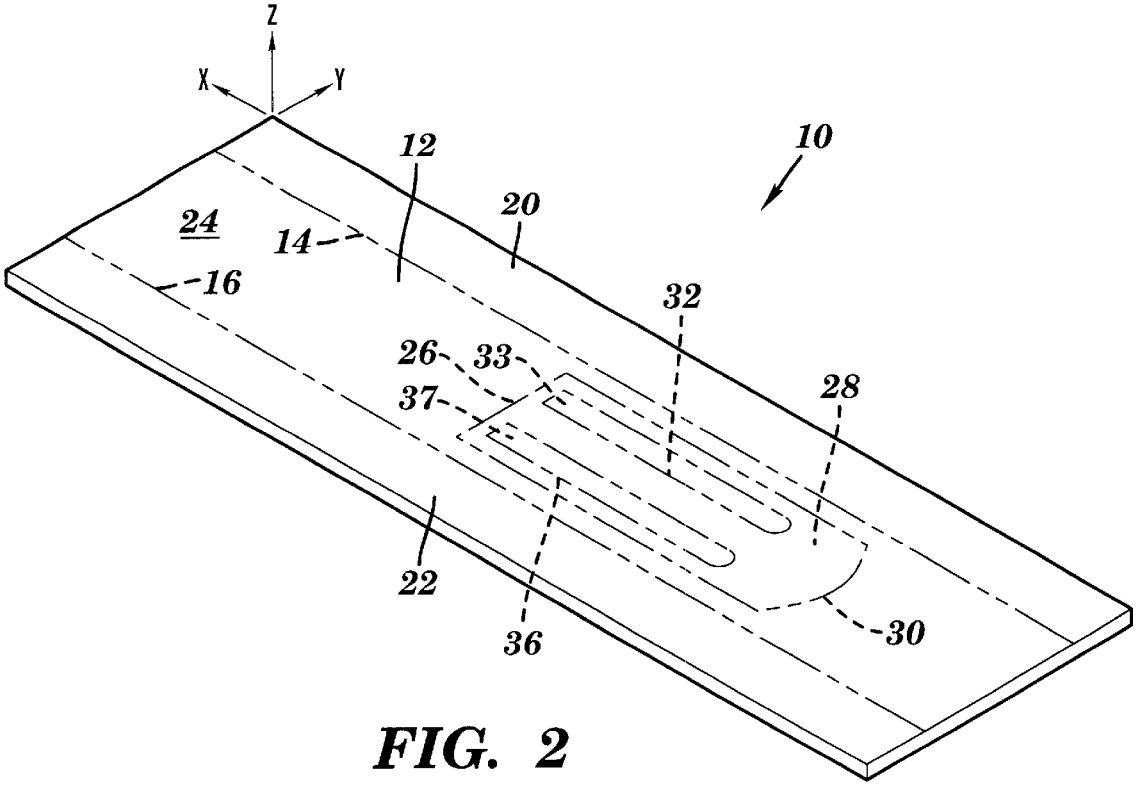
FIG. 2 depicts FIG. 1 with added lines on the surface of the metal sheet for denoting where cutting and bending will subsequently occur to form a deflector track having a tab.

FIG. 2 illustrates FIG. 1 with lines 14, 16, and 26, and curves 30, 32, and 36 on the surface 12 of the metal sheet 10. The aforementioned lines denote where cutting and rotational bending will subsequently occur for forming a deflector track. The metal sheet 10 includes a middle region 24, an end regions 20 and 22. The middle region 24 will subsequently become a web of the deflector track, as will be explained infra in conjunction with FIG. 3. The end regions 20 and 22 will subsequently become flanges of the deflector track, as will likewise be explained infra in conjunction with FIG. 3.

Returning to FIG. 2, the line 14 is oriented in the x-direction and identifies a boundary of the region 20. The line 16 is oriented in the x-direction and identifies a boundary of the end region 22. Lines 14 and 16 constitute lines about which the end regions 20 and 22 will be rotationally bent, respectively, to form the deflector track. The line 26 is oriented in the y-direction and, together with the curve 30, constitutes a closed perimeter of a tongue 28. Thus the line 26 is an end of the tongue 28. The tongue 28 will subsequently become a tab of the deflector track, as will be explained infra in conjunction with FIG. 3. Although FIG. 2 shows only one tongue, namely the tongue 28, the metal sheet 10 may include as many tongues as can fit on the metal sheet 10, and generally includes at least one tongue. If the metal sheet 10 includes at least 3 tongues, then the at least 3 tongues are preferably equally spaced apart along the length of the metal sheet 10.

Returning to FIG. 2, the curve 32 is a closed curve that bounds a region 33, wherein the region 33 will subsequently become a first slat of the deflector track tab. Similarly, the curve 36 is a closed curve that bounds a region 37, wherein the region 37 will subsequently become a second slat of the deflector track tab.

Figure 3:
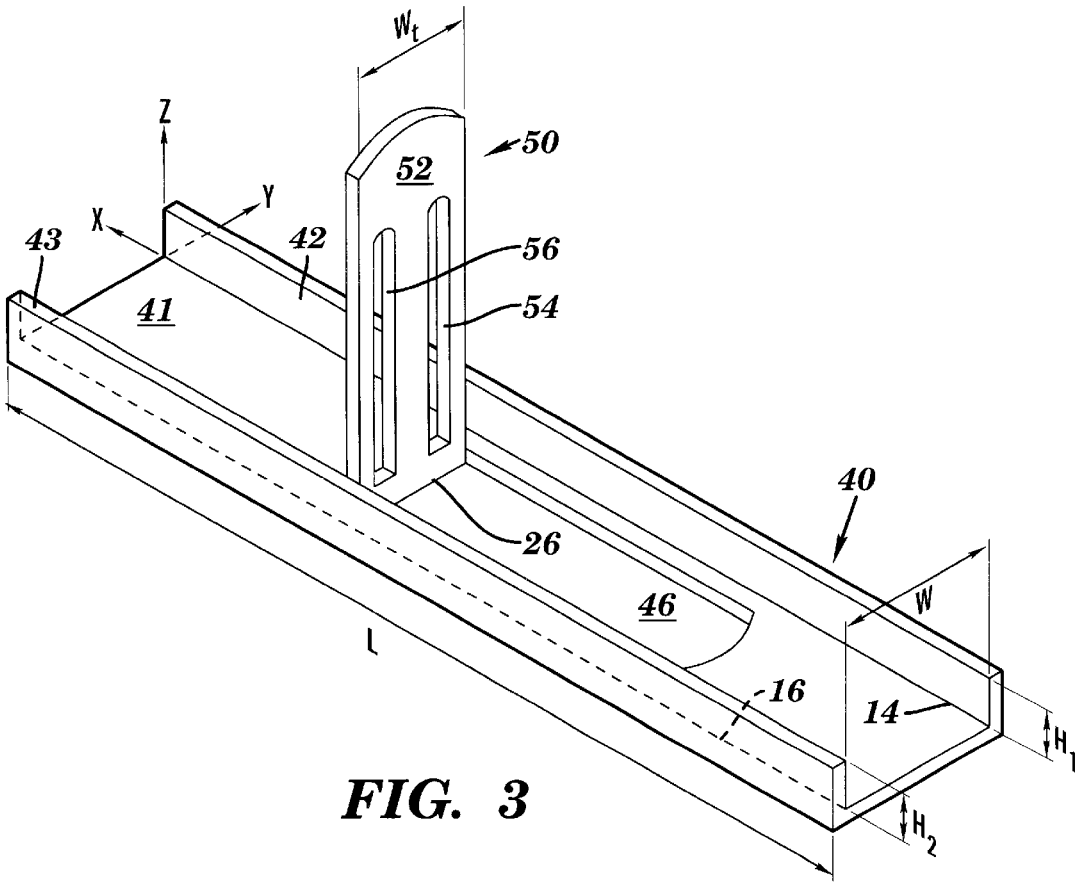
FIG. 3 depicts FIG. 2 after the deflector track having a tab has been formed from the metal sheet.

FIG. 3 depicts FIG. 2 after a deflector track 40 has been formed from the metal sheet 10 of FIG. 2. The deflector track 40 includes a web 41, flanges 42 and 43, and a tab 50. The deflector track web 41, and deflector track flanges 42 and 43, were formed by rotationally bending the regions 20 and 22 of FIG. 2 about the lines 14 and 16, respectively, through an angle of 90 degrees such that the resultant flanges 42 and 43 are oriented in the z-direction and are normal to the resultant deflector track web 41. The aforementioned rotational bending may be accomplished by any method known to one of ordinary skill in the art, such as by press breaking and roll forming. The deflector track web 41 may have any length L that enables the deflector track 40 to fit between vertically-oriented posts in a building and preferably is between about 10 feet and about 30 feet. The deflector track web 41 has a width W preferably between about 4 inches and about 12 inches. The track flanges 42 and 43 have heights $H_1$ and $H_2$, respectively, wherein $H_1$ is preferably about equal to $H_2$. The track flanges heights $H_1$ and $H_2$ must respectively exceed $K_1+\delta$ and $K_2+\delta$. $H_1$ and $H_2$ are preferably equal to about $K_1+\delta+1/8$ inch and $K_2+\delta+1/8$ inch, respectively. $K_1$ and $K_2$ are no-load (i.e., no gravitational live load) separation distances between the deflector track web 41 and studs coupled to the deflector track 40, as defined and explained in FIG. 7 and the discussion accompanying FIG. 7. $\delta$ is a predetermined maximum allowed track deflection from gravitational live load. Note that $\delta$ may be adjusted for thermal expansion or contraction of studs to be installed below the deflector track 40. The gravitational contribution to $\delta$ is dictated by engineering standards or building codes, and is typically within a range of about 0.5 inches to about 1.5 inches with one inch commonly used. The thermal contribution to $\delta$ includes an adjustment for thermal expansion or contraction of the studs beneath the deflector track 40 as may occur from the temperature changes relative to the ambient temperature at the time of installation of the studs in the building. For example, steel expands or contracts approximately 0.01 inches per °F change in temperature, so that a ten-foot length of floor-to-floor steel stud would expand or contract by 0.1 inches for a 100° F. increase or decrease in temperature, respectively. Thus in the foregoing example, if the gravitational contribution to $\delta$ is one inch, then the thermally adjusted value of $\delta$ is 1.1 inches. See FIG. 7 and the discussion accompanying FIG. 7 for an explanation of why $H_1$ and $H_2$ must respectively exceed $K_1+\delta$ and $K_2+\delta$.

The tab 50 in FIG. 3 includes a tab body 52, a tab slat 54, and a tab slat 56. The tab 50 was formed by cutting through the thickness of the middle region 24 along the curve 30 in FIG. 2, followed by rotationally bending the tongue 28 of FIG. 2 ninety degrees about the line 26 such that the resultant tab 50 of FIG. 3 is normal to the deflector track web 41. The aforementioned cutting may be accomplished by any method known to one of ordinary skill in the art, such as by stamping, shear punching, and plasma cutting. The aforementioned rotational bending of the tongue 28 may be accomplished by any method known to one of ordinary skill in the art such as by press breaking. After the aforementioned bending of tongue 28, the line 26 remains as an end of the tab 50. The tab slat 54 in the tab 50 was formed by cutting through the thickness of the tongue 28 along the curve 32 in FIG. 2 to remove the region 33. The tab slat 56 in the tab 50 was formed by cutting through the thickness of the tongue 28 along the curve 36 in FIG. 2 to remove the region 37. The aforementioned cutting may be accomplished by any method known to one of ordinary skill in the art such as by stamping, shear punching, and plasma cutting. The tab slats 54 and 56 may be formed concurrently or in sequence. The flanges 42 and 43, may be formed prior to, concurrent with, or after formation of the tab 50. The tab slats 54 and 56 may be formed prior to, concurrent with, or after formation of the tongue 28 of FIG. 2.

Although FIG. 3 shows the two slats 54 and 56 in the tab 50, the tab 50 may contain any number of slats, and generally contains at least one slat. An increasing number of slats may be needed as the width (W) of the deflector track web 41 increases. The tab 50 preferably contains two slats if the width of the deflector track web 41 is less than about 8 inches, and preferably contains at least three slats if the width of the deflector track web 41 exceeds about 8 inches. The width (W) of the tab 50 must be at least as large as is necessary for the tab 50 to contain its tabs, and may be as large as the width (W) of the deflector track web 41. Note that the width of the tab 50 and the width of the deflector track web 41 are both oriented in the same direction, namely the y-direction.

Inasmuch as the tab 50 was formed out of the sheet of metal 10 (see FIG. 2), the tab 50 in FIG. 3 is integral with the deflector track web 41; i.e., the tab 50 is continuously and mechanically integrated with the deflector track web 41. Since the tab 50 is integral with the deflector track web 41, the thickness of the tab 50 (i.e., spatial extent of the tab 50 in the x-direction) is equal to the thickness of the deflector track web 41 (i.e., spatial extent of the deflector track web 41 in the z-direction). This one-piece design feature of the present invention of having the tab 50 as integral with the deflector track web 41 reduces both material and fabrication costs, since the tab 50 is derived directly from the deflector track web 41 and may be formed as part of the overall process of fabricating the deflector track 40.

Figure 4:
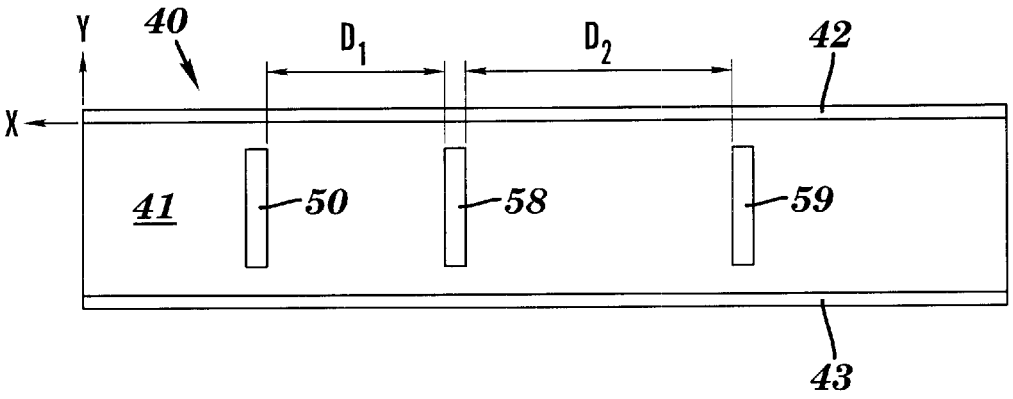
FIG. 4 depicts a top view of the deflector track of FIG. 3 showing additional tabs.

FIG. 4 depicts a top view of the deflector track FIG. 3 showing, in addition to the tab 50, tabs 58 and 59. The widths of the tabs 50, 58, and 59 (i.e., spatial extent of the tabs in the y-direction) are preferably equal. The tabs 50, 58, and 59 are each preferably located symmetrically between the track flanges 42 and 43. The spacing $D_1$ between the tabs 50 and 58, and the spacing $D_2$ between the tabs 58 and 59, are preferably equal. The spacings $D_1$ and $D_2$ are each preferably between about 16 inches and 24 inches. While FIG. 4 shows three tabs (i.e., the tabs 50, 58, and 59, the deflector track 40 many have any number of tabs that can fit within the length L of the deflector track 40 (see FIG. 3), and generally includes at least one tab.

Figure 5:
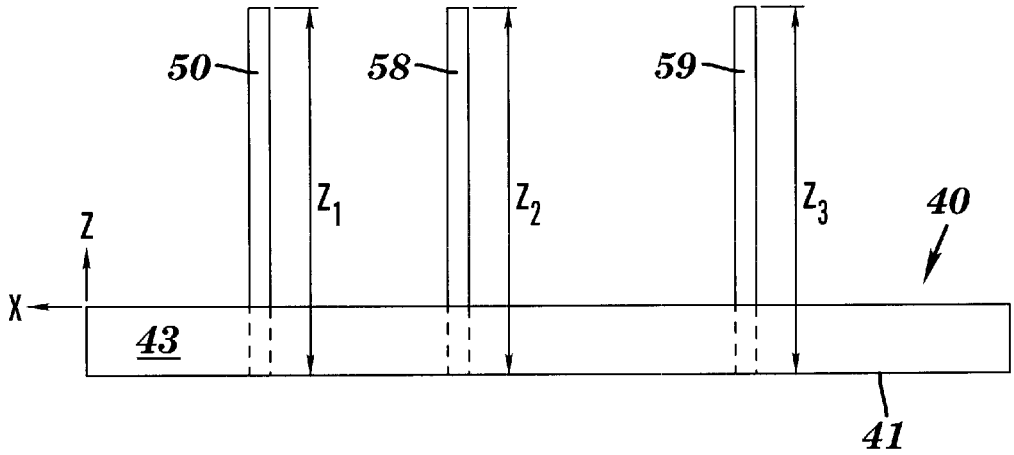
FIG. 5 depicts a side view of the deflector track of FIG. 3 showing the additional tabs.

FIG. 5 depicts a side view of the deflector track FIG. 3 showing, in addition to the tab 50, the tabs 58 and 59 that were discussed supra in relation to FIG. 4. The tabs 50, 58, and 59 are each normal to the deflector track web 41. The heights of the tabs 50, 58, and 59 above the deflector track web 41, namely $Z_1$, $Z_2$, and $Z_3$, respectively, are preferably equal to one another.

Figure 6:
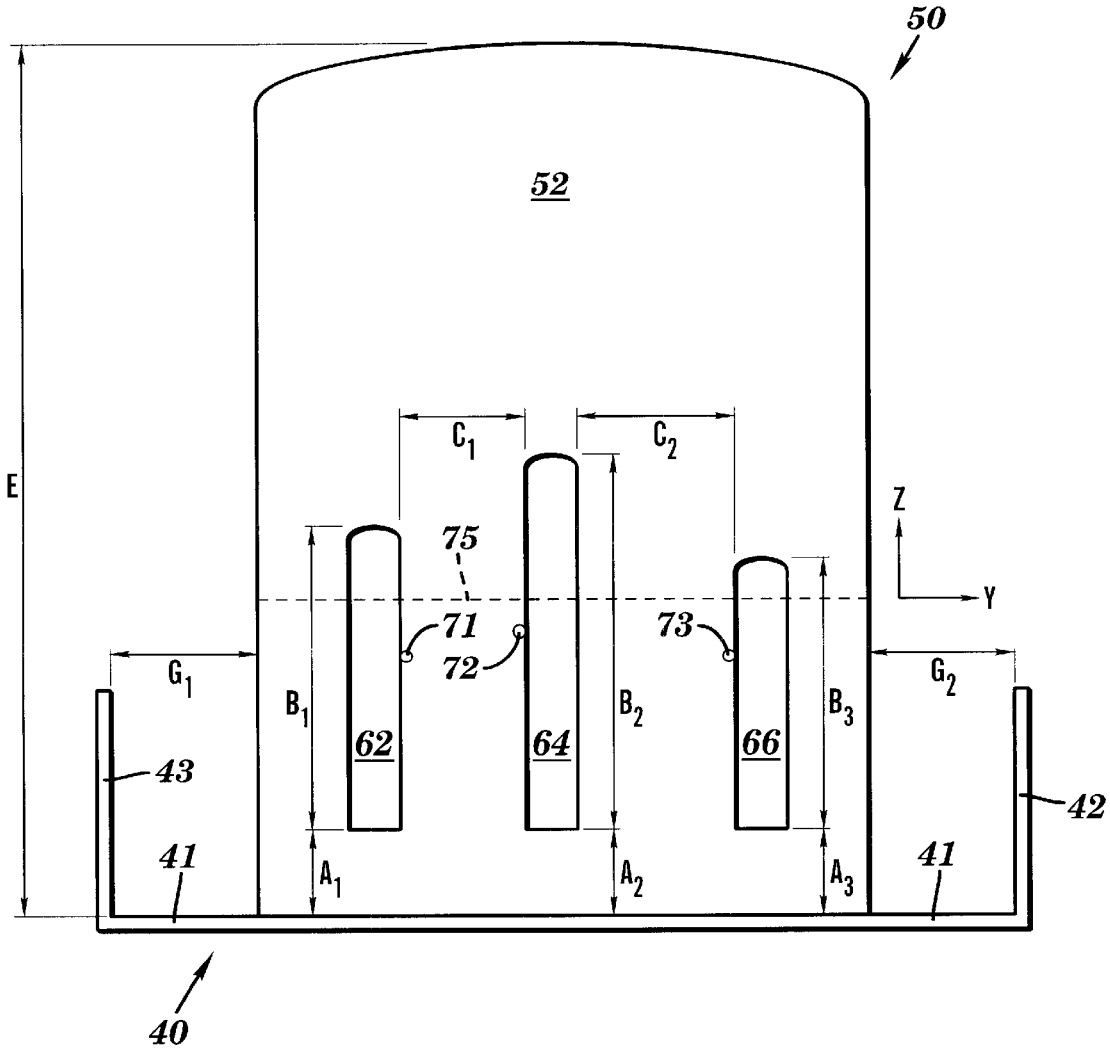
FIG. 6 depicts a front cross-sectional view of the tab of FIG. 3 with three slats in the tab.

FIG. 6 depicts a front cross-sectional view of the tab of FIG. 3 with the two slats 54 and 56 in the tab 50 of FIG. 3 replaced by three slats, namely slats 62, 64, and 66. The slats 62, 64, and 66 are above the deflector track web 41 by an amount $A_1$, $A_2$, and $A_3$, respectively, wherein $A_1$, $A_2$, and $A_3$ are preferably equal to one another. $A_1$, $A_2$, and $A_3$ are each preferably between about $0.25\delta$ and about $0.75\delta$. The slats 62, 64, and 66 each have a length $B_1$, $B_2$, and $B_3$, respectively, wherein $B_1$, $B_2$, and $B_3$ are preferably equal to one another. $B_1$, $B_2$, and $B_3$ must exceed $2\delta$, to enable a stud attached to the tab 50 to move by an amount $\delta$ in either the positive z-direction or the negative z-direction. See FIG. 7 and accompanying description for a discussion of how a stud may be coupled to the tab 50 and how gravitational live load on a floor above or below the stud can cause relative motion between the stud and the deflector track 40 of up to $\delta$ in either the positive z-direction or the negative z-direction. The spacing $C_1$ between the slats 62 and 64, and the spacing $C_2$ between the tabs 64 and 66, are preferably equal. The height E of the tab 50 must exceed the maximum of: $A_1+B_1$, $A_2+B_2$, and $A_3+B_3$. While FIG. 6 shows three slats in the tab 50, the tab 50 may include any number of slats that can be physically formed in the tab 50, including at least one slat. $G_1$ and $G_2$ denote separations between the deflector track tab 50 and deflector track flanges 42 and 43, respectively, in the y-direction, wherein it is preferred that $G_1$ and $G_2$ be about equal.

The tab 50 may include a marker pattern for denoting a position on each slat. The marked position on each slat locates where a fastener will subsequently couple (such as by fastening with a screw) a stud to the tab 50 after the deflector track 40 (see FIG. 3) is installed in a building. An example of a marker pattern is the line 75 that is about parallel to the deflector track web 41, wherein intersections of the line 75 with the slats 62, 64, and 66 mark where on the slats 62, 64, and 66, respectively, a stud will be subsequently fastened. The line 75 may be, inter alia, an imprint or a scratch into the surface of the deflector tab body 52. The line 75 may also be a series of dashes (as shown), a series of dots, or continuous lines between slats 62, 64, and 66. Another example of a marker pattern is a combination of the mark 71, the mark 72, and the mark 73, for respectively marking positions on the slats 62, 64, and 66 at which a stud will be subsequently fastened. Any marker pattern that identifies one position on each of the slats 62, 64, and 66 are within the scope of the present invention. The positions on the slats 62, 64, and 66 identified by a marker pattern are preferably each about a same distance from the deflector track web 41.

Figure 7:
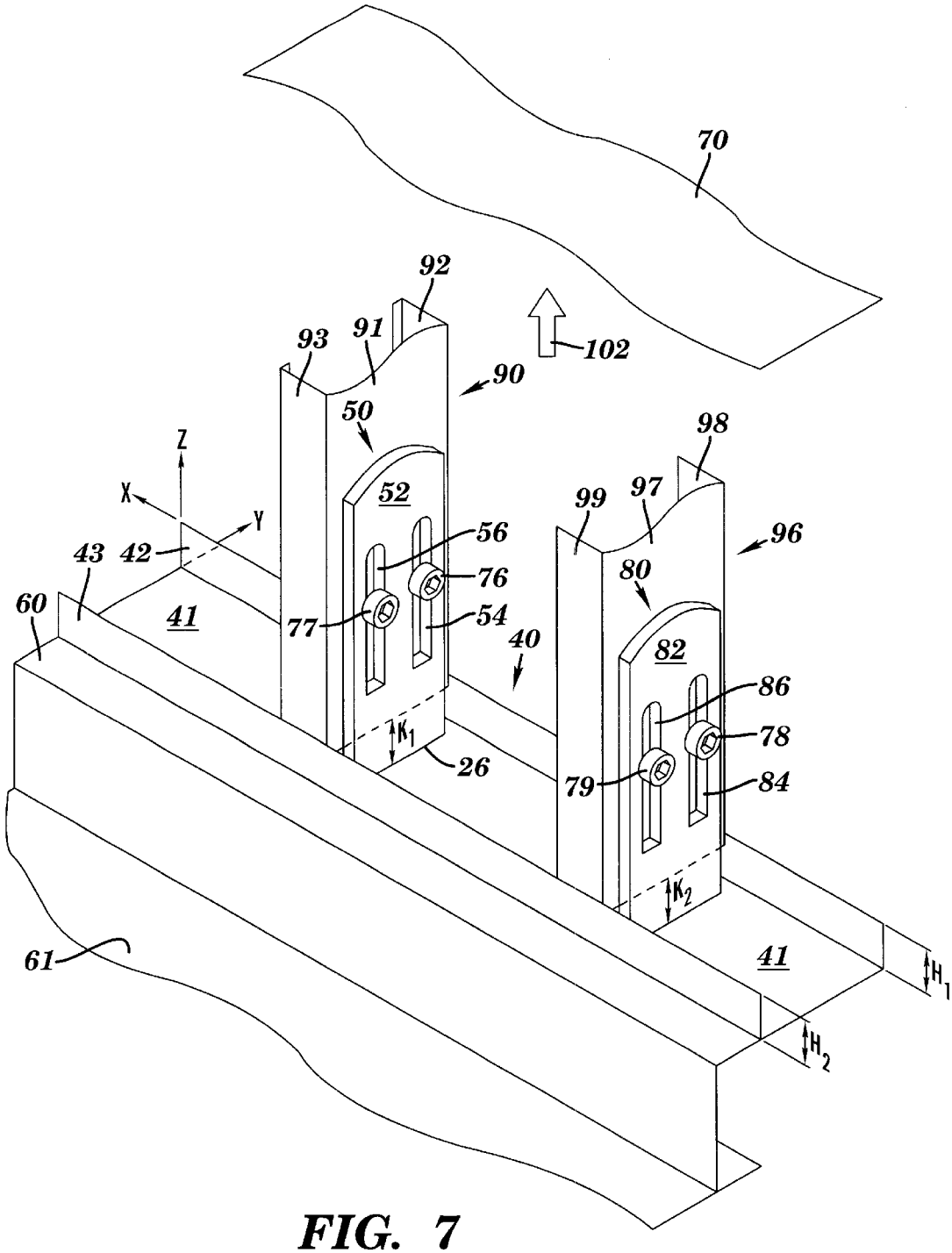
FIG. 7 depicts FIG. 3 with an added tab and studs attached to the tabs.

FIG. 7 illustrates the web 41 of the deflector track 40 of FIG. 3 coupled to a ceiling structure 60. FIG. 7 also shows a stud 90 attached to the tab 50, and a stud 96 attached a tab 80 of the deflector track 40. The ceiling structure 60 couples the deflector track 40 to a floor 61 directly above the deflector track 40 by such coupling mechanisms as bar joists and I-beams. The z-direction and the direction arrow 102 in FIG. 7 are both pointing "downward;" i.e., gravitationally toward the earth's surface 70 from the ceiling structure 60. From this point of view, the ceiling structure 60 is "higher" than the deflector track 40, and the deflector track web 41 is "above," or "higher" than the studs 90 and 96. Note that the deflector track web 41 is oriented horizontally (i.e., in the x-direction), and the deflector track flanges 42 and 43 are pointing vertically downward (i.e., in the z-direction, or in the direction 102).

A process for generating the configuration of FIG. 7 includes: coupling the web 41 of the deflector track 40 to the ceiling structure 60; attaching the studs 90 and 96 to the tabs 50 and 80, respectively, in an orientation normal to the track web 41, such that the studs 90 and 96 are each separated from the track web 41 by more than δ, including respectively fastening the webs 91 and 97 of the studs 90 and 96 to the tabs 50 and 80 in a way that inhibits horizontal motion of the tabs 50 and 80 relative to the studs 90 and 96, respectively.

In FIG. 7, the tab 80 includes a tab body 82, and slats 84 and 86. The stud 90 includes a web 91, and flanges 92 and 93, such that a cross-section of the stud 90 is C-shaped. The stud 96 includes a web 97, and flanges 98 and 99, such that a cross-section of the stud 96 is C-shaped. Other cross-sectional shapes for the studs 90 and 96 are within the scope of the present invention; e.g., a stud having a web and only one flange, or a stud having a web with two flanges with other appended structures integral with either or both flanges. The studs 90 and 96 include any material, such as steel, that is useful in the framing of a building. The studs 90 and 96 may be part of the exterior framing or as part of the interior framing of the building. If part of the exterior framing, the studs 90 and 96 must be thick enough (e.g., steel of 18 guage or thicker) to be able to withstand wind stress as dictated by engineering standards or building codes. In New York State, for example, the studs must be able to withstand a wind stress standard of up to about 15 $lb/ft^2$, which is equivalent to a wind of about 90 mi/hr. If part of the interior framing, the studs 90 and 96 may be thinner (e.g., 20 guage steel), since the studs 90 and 96 would not be required to withstand wind stress.

The stud 90 is loosely attached to the tab 50 at the slats 54 and 56 by use of attachment devices 76 and 77, respectively. The attachment device 76 (or 77) may include, inter alia, a screw, wherein the screw is mechanically affixed to the stud web 91, and wherein the screw passes through (but is not affixed to) the slat 54 (or 56). The attachment devices 76 and 77 must each be located a distance exceeding δ from each end (in the z-direction) of the slats 54 and 56, respectively (see, by way of analogy, the ends 48 and 49 of the slat 54 in FIG. 8). The attachment devices 76 and 77 should preferably be located at the midpoint of slats 54 and 56, respectively, along the length of the slats 54 and 56 in the z-direction. The aforementioned attachment of the stud 90 to the tab 50 is loose in the sense that the attachment inhibits relative motion between the stud 90 and the deflector track web 41 in the x-direction and y-direction, but does not inhibit relative motion between the stud 90 and the deflector track web 41 in the z-direction. The attachment devices 76 and 77 serve to protect the stud 90 against wind stress in the horizontal direction; i.e., in the y-direction normal to the stud flange 92 or the stud flange 93. Note that the stud 90 is separated in the z-direction from the deflector track web 41 by an amount $K_1$, wherein $K_1$ must exceed δ. The permissible relative motion of between the stud 90 and the deflector track web 41 in the z-direction is facilitated by the slats 54 and 56 which respectively allows for relative motion in the z-direction between the tab 50 and the attachment devices 76 and 77. Note that the attachment devices 76 and 77 may be located along the slats 54 and 56, respectively, by use of a marked pattern as explained supra in conjunction with FIG. 6.

The stud 96 is loosely attached to the tab 80 at the slats 84 and 86 by use of attachment devices 78 and 79, respectively. The attachment device 78 (or 79) may include, inter alia, a screw, wherein the screw is mechanically affixed to the stud web 97, and wherein the screw passes through (but is not affixed to) the slat 84 (or 86). The attachment devices 78 and 79 must be located a distance of at least δ from each end (in the z-direction) of the slats 84 and 86, respectively. The attachment devices 78 and 79 should preferably be located at the midpoint of slats 84 and 86, respectively, along the length of the slats 84 and 86 in the z-direction. The aforementioned attachment of the stud 96 to the tab 80 is loose in the sense that the attachment inhibits relative motion between the stud 96 and the deflector track web 41 in the x-direction and y-direction, but does not inhibit relative motion between the stud 96 and the deflector track web 41 in the z-direction. The attachment devices 78 and 79 serve to protect the stud 96 against wind stress in the horizontal direction; i.e., in the y-direction normal to the stud flange 98 or the stud flange 99. Note that the stud 96 is separated in the z-direction from the deflector track web 41 by an amount $K_2$, wherein $K_2$ must exceed δ. Preferably, $K_2$ is about equal to $K_1$. The permissible relative motion of between the stud 96 and the deflector track web 41 in the z-direction is facilitated by the slats 84 and 86 which respectively allows for relative motion in the z-direction between the tab 80 and the attachment devices 78 and 79. Note that the attachment devices 78 and 79 may be located along the slats 84 and 86, respectively, by use of a marked pattern as explained supra in conjunction with FIG. 6.

The tabs 50 and 80 of the present invention serve to automatically position the studs 90 and 96, respectively, along the deflector track web 41. This automatic positioning of the studs substantially reduces labor costs in comparison with the present method of measuring along a horizontally-oriented track to position the studs.

With reference to FIG. 7, the role of δ in the present invention is explained as follows. The deflector track 40, as installed in a building, has the deflector track web 41 mechanically coupled to the floor 61 above deflector track 40, wherein said coupling by the ceiling structure 60 may include affixation of the deflector track web 41 to a ceiling under the floor 61 with use of a bar joist and I-beam between the ceiling and the floor 61. Thus upon installation of the deflector track 40 and the studs 90 and 96, the direction 102 in FIG. 7 is in the z-direction and points gravitationally downward from the floor 61 above the deflector track 40 to a floor below (not shown) the studs 90 and 96. The deflector track 40 points in the direction of the earth's surface 70 beneath the floor below the studs 90 and 96. After the deflector track 40 is mechanically coupled to the floor 61 above, the studs 90 and 96 will be attached to the floor below, such that the studs 90 and 96 will be fixed in place and not free to move relative to the floor below. Gravitational live loads directed gravitationally downward on the floor 61 will be transmitted in the direction 102 to the deflector track 40, causing the deflector track to move gravitationally downward in the direction 102 toward the studs 90 and 96. However, if both $K_1$ and $K_2$ exceed $\delta$ when there is no gravitational live load present, then the deflector track cannot contact studs 90 and 96 in the presence gravitational live load. Thus, the present invention prevents the gravitational live load from being transferred to the studs 90 and 96. Note that $\delta$ may account for thermal expansion or contraction of the 90 and 96 as stated supra. Also as stated supra, the studs are unable to withstand gravitational live loads and must therefore be protected from the gravitational live loads.

If the floor below the studs 90 and 96 is subject to downward motion in the direction 102 from a gravitational live load, then the studs 90 and 96 will move with the floor below in the direction 102 by a distance of up to $\delta$. Thus the heights $H_1$ and $H_2$ of the track flanges 42 and 43, respectively, must each be of magnitude exceeding $K_{12}+\delta$, where $K_{12}$ is the maximum of $K_1$ and $K_2$. The aforementioned constraints on $H_1$ and $H_2$ prevents the studs 90 and 96 from moving out of contact with the deflector track flanges 42 and 43 when the floor below is depressed by live gravitational load. Thus, for example, if $K_1$ and $K_2$ are equal to $1.01\delta$ and $1.04\delta$, respectively, then $H_1$ and $H_2$ must each exceed $2.04\delta$.

As stated supra, the permissible relative motion between the stud 90 and the deflector track web 41 in the z-direction is facilitated by the slats 54 and 56 which allow for relative motion in the z-direction between the tab 50 and the attachment devices 76 and 77, respectively. The slats 54 and 56 must each be of sufficient length to accommodate a movement of up to $\delta$ by the deflector track web 41 in the direction 102 (resulting from gravitational live load on the floor 61 above the deflector track web 41), and a movement of up to $\delta$ by the stud 90 in the direction 102 (resulting from gravitational live load on the floor below the studs 90 and 96). Thus, if the attachment devices 76 and 77 are located at the midpoint of slats 54 and 56, respectively, along the length of the slats 54 and 56 in the direction 102, then the length of the slats 54 and 56 must exceed $2\delta$. If the attachment device 76 (or 77) is offset "above" the midpoint of slat 54 (or 56) (i.e., in the direction opposite to 102), then the length of the slat 54 (or 56) must exceed $2\delta$ plus the amount of offset relative to the midpoint of the slat 54 (or 56), such that the attachment device 76 (or 77) is free to move vertically upward or downward by a distance of up to $\delta$.

Figure 8:
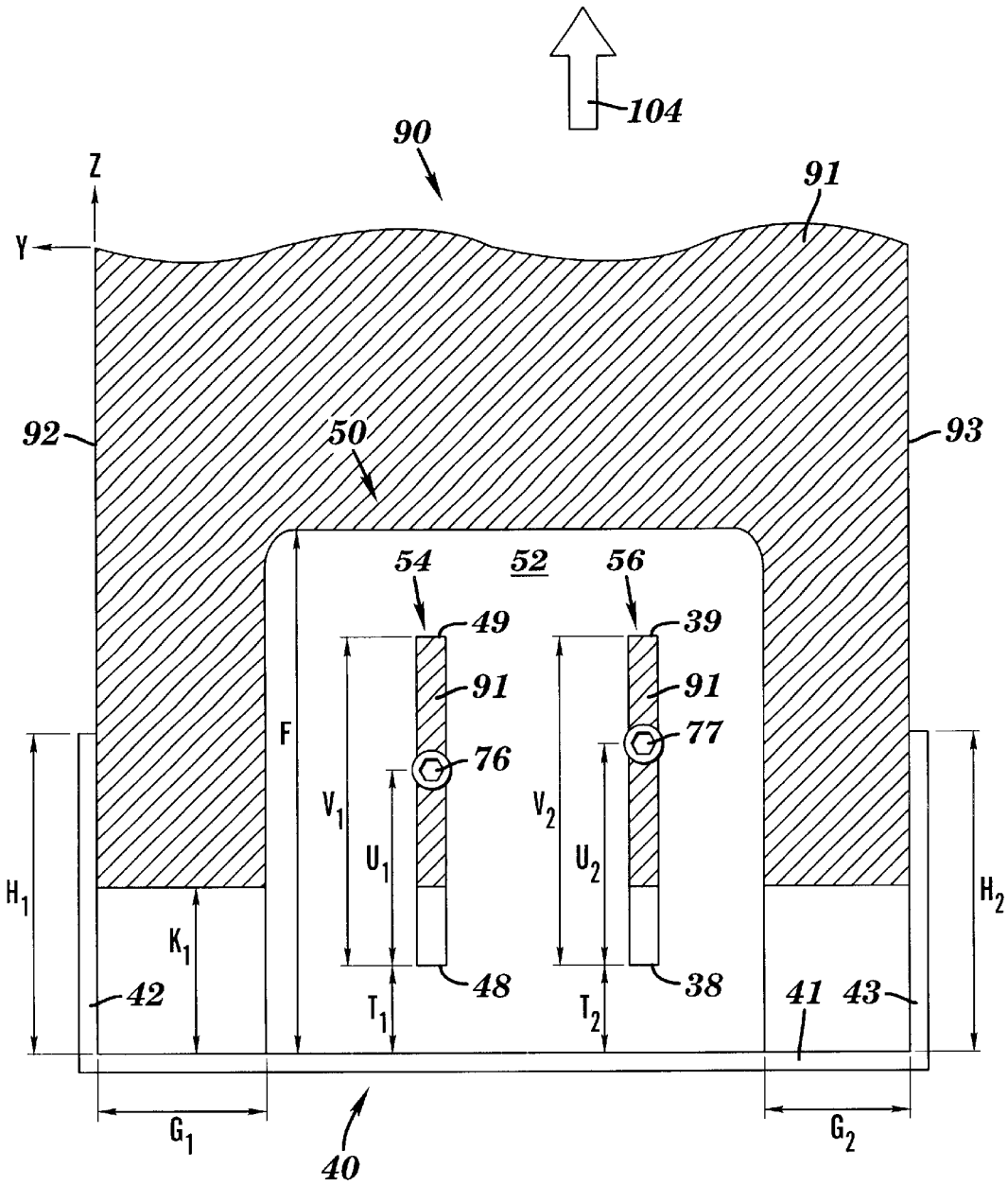
FIG. 8 depicts a front cross-sectional view of a tab of FIG. 7, wherein the tab is coupled to a stud within the deflector track.

FIG. 8 illustrates a front cross-sectional view of the tab 50 of FIG. 7, wherein the tab 50 is coupled to a stud within the deflector track 40, and wherein the direction 104 is gravitationally downward in the z-direction. Note that the stud web 91 is visible within the deflector tab slats 54 and 56. The various linear dimensions depicted in FIG. 8 are defined as follows. $H_1$ and $H_2$ are the heights of the deflector track flanges 42 and 43, respectively, above the deflector track web 41. $K_1$ is an initial no-load (i.e., no gravitational live load and no thermal expansion) separation between the stud 90 and the deflector track web 41. F is the height of the deflector track tab 50 above the deflector track web 41. $G_1$ and $G_2$ denote the separation between the deflector track tab 50 and deflector track flanges 42 and 43, respectively, in the y-direction. It is preferred that $G_1$ and $G_2$ be about equal. $T_1$ and $T_2$ denote the separation between the deflector tab slats 54 and 56, respectively, and the deflector track web 41. It is preferred that $T_1$ and $T_2$ be about equal. $V_1$ is the length of the deflector tab slat 54 (in the z-direction) between slat ends 48 and 49. $V_2$ is the length of the deflector tab slat 56 (in the z-direction) between slat ends 38 and 39. It is preferred that $V_1$ and $V_2$ be about equal. $U_1$ is a height of the attachment device 76 above the end 48 of the deflector tab slat 54. $U_2$ is a height of the attachment device 77 above the end 38 of the deflector tab slat 56. It is preferred that $U_1$ and $U_2$ be about equal. Note that the attachment devices 76 and 77 may be located along the slats 54 and 56, respectively, by use of a marked pattern as explained supra in conjunction with FIGS. 6 and 7.

Figure 9:
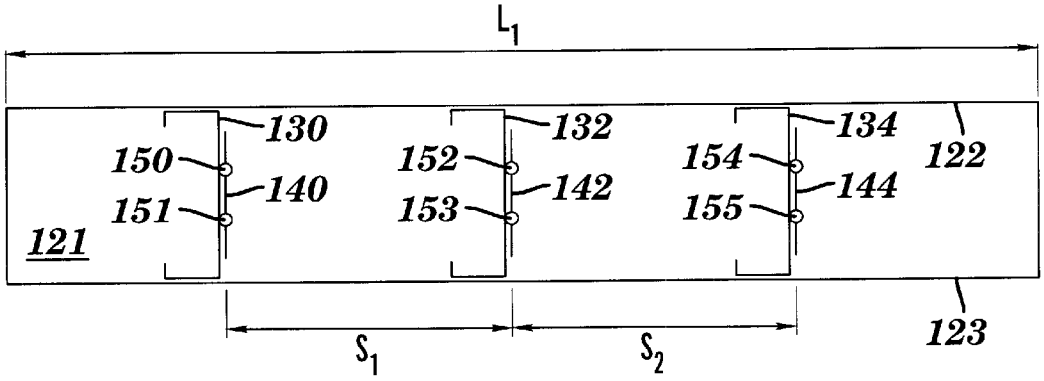
FIG. 9 depicts a top view of studs coupled to tabs of a deflector track, in accordance with a preferred embodiment of the present invention.

Based on the previous discussion of FIGS. 3, 6, and 7, mathematical formulas relating to the aforementioned linear dimensions in FIG. 8 are as follows:

$K_1>\delta$;
$H_1>K_1+\delta$;
$H_2>K_1+\delta$;
$T_1>0$;
$T_2>0$;
$U_1>\delta$;
$U_2>\delta$;
$V_1>U_1+\delta$;
$V_2>U_2+\delta$;
$G_1>0$;
$G_2>0$; and
$F>$maximum of $(T_1+V_1)$ and $(T_2+V_2)$ FIG. 9 illustrates a top view of studs 130, 132, and 134 respectively coupled to tabs 140, 142, and 144 of a deflector track 120, in accordance with a preferred embodiment of the present invention. The deflector track 120 is horizontally oriented within a building and is mechanically coupled to a floor directly above the deflector track 120. The deflector track 120 includes a web 121, and flanges 122 and 123. The top view in FIG. 9 is a view looking downward from the surface of the deflector track web 121 that is furthest from the floor above (or closest to the ground below). The stud 130 is mechanically coupled to the tab 140 by attachment devices 150 and 151. The stud 132 is mechanically coupled to the tab 142 by attachment devices 152 and 153. The stud 134 is mechanically coupled to the tab 144 by attachment devices 154 and 155. $S_1$ is the distance between the stud 130 and the stud 132, as well as the distance between the tab 140 and the tab 142. $S_2$ is the distance between the stud 132 and the stud 134, as well as the distance between the tab 142 and the tab 144. $S_1$ and $S_2$ are preferably equal. $S_1$ and $S_2$ may each have any value consistent with the length of the deflector track 120, and typically have a value between about 16 inches and about 24 inches. Although the three studs 130, 132, and 134 (and associated deflector track tabs 140, 142, and 144) are shown in FIG. 9, the deflector track 120 may include any number of studs (and associated deflector track tabs) that can be placed within the length $L_1$ of the deflector track 120, and generally include at least one stud (and associated at least one tab). The studs 130, 132, and 134 may be part of an exterior framing or as part of an interior framing of the building.

While preferred and particular embodiments of the present invention have been described herein for purposes of illustration, many modifications and changes will become apparent to those skilled in the art. Accordingly, the appended claims are intended to encompass all such modifications and changes as fall within the true spirit and scope of this invention.

We claim:

1. A method for forming a deflector track structure that includes a deflector track, comprising the steps of:

predetermining a maximum allowed track deflection δ under gravitational live load normal to a web of the deflector track;

predetermining a length K, wherein K exceeds δ, wherein K is a no-load distance that will separate the web and a stud after the stud is subsequently coupled to the track, and wherein the stud is adapted to be coupled to the track;

providing a sheet of metal having a length along an x-direction, a width along a y-direction, and a thickness along a z-direction, wherein the x-direction, the y-direction, and the z-directions define an orthogonal coordinate system;

forming at least one tongue within the sheet of metal, wherein an end of the tongue is integral with the sheet, and wherein the end of the tongue is oriented in the y-direction;

forming at least one slat within the tongue, wherein the slat is oriented in the x-direction, and wherein a length of the slat in the z-direction exceeds 2δ;

bending the tongue rotationally about the end of the tongue, resulting in the tongue becoming a tab oriented in the z-direction such that the end of the tongue remains as an end of the tab;

bending a first side of the sheet of metal rotationally about a first line in the sheet of metal to form a first flange of the deflector track, wherein the first line is oriented in the x-direction, wherein the first flange is oriented in the z-direction, wherein the web of the deflector track remains, wherein a length of the web is oriented in the x-direction, and wherein a height of the first flange in the z-direction exceeds K+δ; and bending a second side of the sheet of metal rotationally about a second line in the sheet of metal to form a second flange of the deflector track, wherein the second line is oriented in the x-direction, wherein the second flange is oriented in the z-direction, and wherein a height of the second flange in the z-direction exceeds K+δ.

2. The method of claim 1, wherein the step of forming a tongue and the step of forming at least one slat within the tongue are performed concurrently.

3. The method of claim 1, wherein the step of forming a tongue and the step of forming at least one slat within the tongue are performed in sequence.

4. The method of claim 1, wherein δ includes an adjustment for thermal expansion or contraction of the stud adapted to be subsequently coupled to the tab.

5. The method of claim 1, wherein δ is about one inch.

6. The method of claim 1, wherein the metal includes steel.

7. The method of claim 1, wherein the step of forming at least one slat includes forming at least two slats.

8. The method of claim 7, wherein an end of each slat is at about a same distance from the web of the track.

9. The method of claim 8, wherein the same distance is between about 0.25 δ and about 0.75 δ.

10. The method of claim 1, wherein the step of forming at least one tongue includes forming at least three tongues.

11. The method of claim 10, wherein the at least three tongues are about equally spaced apart along the length of the sheet of metal.

12. The method of claim 1, further comprising forming a marker pattern on the tab for denoting a position on each slat, wherein the position on the slat is at a distance U from an end of the slat, wherein U exceeds δ, and wherein the length of the slat exceeds U+δ.

13. The method of claim 12, wherein U has about the same value for each slat.

14. The method of claim 12, further comprising:

coupling the web of the deflector track to a ceiling structure, wherein the web of the deflector track is oriented horizontally, and wherein the first flange and the second flange are each pointing vertically downward; and coupling the stud to the tab, comprising the steps of:

providing the stud, wherein the stud includes a web and two flanges;

vertically orienting the stud;

setting an end of the stud within the track, wherein the stud web is oriented normally to the track web; and fastening a web of the stud to the tab at the position on each slat of the tab, wherein the fastening inhibits horizontal motion of the tab relative to the stud.

15. A deflector track, comprising:

a web made of a metal and having a length, a width, and a thickness;

a first flange on a first side of the web, wherein the first flange is integral with the web, wherein the first flange is oriented in a direction normal to the web, wherein a height of the first flange exceeds K+δ, wherein δ is a predetermined maximum allowed track deflection under gravitational live load normal to the web of the deflector track, wherein K is a length that exceeds δ, wherein K is a no-load distance that will separate the web and a stud after the stud is subsequently coupled to the track, and wherein the stud is adapted to be coupled to the track;

a second flange on a second side of the web, wherein the second flange is integral with the web, wherein the second flange is oriented in the direction normal to the web, and wherein a height of the second flange exceeds K+δ; and at least one tab, wherein the tab is integral with the web, wherein a width of the tab is oriented along a width of the web, wherein a height of the tab is oriented in the direction normal to the web, wherein the tab includes at least one slat, wherein the slat has a length that exceeds 2 δ; and wherein the slat is oriented in the direction of the height of the tab.

16. The deflector track of claim 15, wherein δ is about one inch.

17. The deflector track of claim 15, wherein the metal includes steel.

18. The deflector track of claim 15, wherein the tab includes at least two slats.

19. The deflector track of claim 18, wherein an end of each slat is at about a same distance from the web of the track.

20. The deflector track of claim 19, wherein the same distance is between about 0.25 δ and about 0.75 δ.

21. The deflector track of claim 15, wherein the tab includes at least three slats.

22. The deflector track of claim 21, wherein the at least three slats are about equally spaced apart along the width of the tab.

23. The deflector track of claim 15, further comprising a marker pattern on the tab for denoting a position on the slat, wherein the position on the slat is at a distance U from an end of the slat, wherein U exceeds δ, and wherein the length of the slat exceeds U+δ.

24. The deflector track of claim 23, wherein U has about the same value for each slat.

25. The deflector track of claim 23, wherein the web of the deflector track is oriented horizontally and adapted to be coupled to a ceiling structure, wherein the first flange and the second flange are each pointing vertically downward, and wherein a web of the stud is adapted to be vertically oriented and fastened to the tab at the position on each slat of the tab in such a manner that the horizontal motion of the stud relative to the tab is inhibited.

26. The deflector track of claim 15, wherein δ includes an adjustment for thermal expansion or contraction of the stud adapted to be subsequently coupled to the tab.

* * * * *